US009459016B1

(12) United States Patent
Kopp

(10) Patent No.: US 9,459,016 B1
(45) Date of Patent: Oct. 4, 2016

(54) AFTER MARKET INSTALLABLE CLOSED LOOP HUMIDIFIER SYSTEM AND KIT UTILIZING HIGH EFFICIENCY FURNACE CONDENSATE WATER OR CITY WATER INLET FOR HUMIDIFYING AN ENCLOSED SPACE

(71) Applicant: Gary E. Kopp, Washington Township, MI (US)

(72) Inventor: Gary E. Kopp, Washington Township, MI (US)

( * ) Notice: Subject to any disclaimer, the term of this patent is extended or adjusted under 35 U.S.C. 154(b) by 0 days.

(21) Appl. No.: 14/965,413

(22) Filed: Dec. 10, 2015

Related U.S. Application Data

(60) Provisional application No. 62/132,454, filed on Mar. 12, 2015.

(51) Int. Cl.

| | |
|---|---|
| ***B01F 3/04*** | (2006.01) |
| ***F24F 3/14*** | (2006.01) |
| ***F24F 3/16*** | (2006.01) |
| ***F24F 13/32*** | (2006.01) |
| ***F24F 13/22*** | (2006.01) |

(52) U.S. Cl.
CPC ..... *F24F 3/1405* (2013.01); *B01F 3/04* (2013.01); *F24F 3/16* (2013.01); *F24F 13/222* (2013.01); *F24F 13/32* (2013.01); *F24F 2003/1667* (2013.01); *F24F 2013/227* (2013.01)

(58) Field of Classification Search
CPC ..... B01F 3/04
USPC ..... 261/36.1, 70, 103
See application file for complete search history.

(56) References Cited

U.S. PATENT DOCUMENTS

| | | | | |
|---|---|---|---|---|
| 3,491,746 | A | 1/1970 | Swimmer et al. | |
| 3,592,182 | A | 7/1971 | Richardson | |
| 3,666,828 | A | 5/1972 | Post et al. | |
| 4,257,389 | A | 3/1981 | Texidor et al. | |
| 5,067,473 | A | 11/1991 | Oh | |
| 5,184,600 | A | 2/1993 | Astle, Jr. | |
| 5,560,350 | A | 10/1996 | Kim | |
| 5,570,680 | A | 11/1996 | Payne | |
| 5,620,302 | A | 4/1997 | Garrison et al. | |
| 6,286,501 | B1 | 9/2001 | Charland | |
| 6,481,232 | B2 | 11/2002 | Faqih | |
| 6,487,867 | B1 | 12/2002 | Herren | |
| 6,845,971 | B2 | 1/2005 | Bachert | |
| 7,392,821 | B2 | 7/2008 | Nakata et al. | |
| 8,104,502 | B2 | 1/2012 | Nakata et al. | |
| 8,252,174 | B2 | 8/2012 | Jones et al. | |
| 8,794,601 | B2 | 8/2014 | Dempsey et al. | |
| 8,845,795 | B2 | 9/2014 | Becze et al. | |
| 8,894,046 | B2 | 11/2014 | Lev | |
| 9,061,923 | B2 | 6/2015 | Hsueh et al. | |
| 2002/0070465 | A1* | 6/2002 | Harvel | F24F 6/04 261/36.1 |
| 2003/0101872 | A1 | 6/2003 | Peel et al. | |
| 2009/0241579 | A1 | 10/2009 | Motegi et al. | |
| 2014/0174423 | A1 | 6/2014 | Wang et al. | |
| 2015/0048530 | A1 | 2/2015 | Cheung et al. | |

*Primary Examiner* — Robert A Hopkins
(74) *Attorney, Agent, or Firm* — Dinsmore & Shohl LLP; Douglas J. McEvoy

(57) ABSTRACT

A retrofit kit and assembly for establishing closed loop water supply to a humidifier associated with a furnace. A reservoir defining housing is adapted to being mounted to an external location of the furnace. A fluid supply communicates to the housing and can include either of a float valve actuated city water inlet line or a water condensate line extending from the furnace. An outlet extends from a location of the housing to the humidifier. A return line extends from the humidifier to a further location of the housing. An overflow drain extends from another location of the housing and communicates any excess volume of water to a floor drain.

18 Claims, 6 Drawing Sheets

AFTER MARKET INSTALLABLE CLOSED LOOP HUMIDIFIER SYSTEM AND KIT UTILIZING HIGH EFFICIENCY FURNACE CONDENSATE WATER OR CITY WATER INLET FOR HUMIDIFYING AN ENCLOSED SPACE

CROSS-REFERENCE TO RELATED APPLICATIONS

This Application claims the benefit of U.S. Provisional Application 62/132,454 filed on Mar. 12, 2015, the contents of which are incorporated herein in its entirety.

BACKGROUND OF THE INVENTION

1. Field of the Invention

The present invention teaches an aftermarket installation assembly for use with an existing home furnace and humidifier for providing recyclable use (i.e. a Green application) of either of a city water input or condensate output of the furnace.

2. Background of the Prior Art

Residential and commercial heating systems require some form of humidification in the winter time. Optimizing the ambient air humidity within an enclosed structure, such as to around 40 to 50% in one preferred application, will save energy costs by having the building occupants will feel warmer at lower temperatures, this also resulting in physiological improvements including decreased incidences of respiratory diseases. Providing adequate humidification also results in reduction in static electricity, and damage to furniture, artwork, paper, and other items sensitive to expansion and contraction are also reduced.

As is also known in the art, the increasing standard of furnaces currently produced are typically of the high efficiency variety. This higher efficiency is a byproduct of bringing in outside air into the fire box, instead of using air from the inside the house or other enclosed structure for combustion.

In operation, furnace exhaust gases pass to an exhaust decoupler, which is part of the sound reduction system of the condensing furnace. In the exhaust decoupler, the gases are cooled in one application from about 700° Fahrenheit to 350° Fahrenheit. The exhaust gases from the exhaust decoupler are forced through a condenser coil and are discharged through the flue gas outlet from the condensing furnace. Exhaust gases passing through the condenser coil are cooled by air passing over the coil so that the exhaust gas will leave at a relatively low temperature, such as 100° Fahrenheit or lower. As the temperature of the gases reach dew point (at about 130° Fahrenheit) in the condenser coil, water is condensed from the gases, allowing the furnace to reclaim the latent heat of combustion. High furnace efficiencies in excess of 91 percent can be achieved in condensing furnaces of the type described. Absent some mechanism integrated into the system for recycling or reuse, the resultant condensate output from the furnace is usually disposed through a sump or drain.

As is also known, typical commercial and residential furnace installations include some form of humidification, in particular in northern climates where the absence of such humidification results in extremely dry humidity conditions in winter months. In a typical application, such humidifiers will input city water and expose it to the hot air stream of the furnace, which moves the air through the building with its fan system.

Water not used in the humidification of the building is typically discharged at the bottom of the humidifier into a sump or directly into the sewer system. If discharged directly into a sump, power is then required to pump the water out of the house and into the city sewer system.

According to one non-limiting operation, a typical evaporative pad type humidifier will use eighty ounces of water in a ten minute furnace run cycle, with only six ounces used for humidification. The other approximately seventy four ounces is discharged into the sewer system as waste.

Thus, in a twenty-four hour period, one residential system wasted twenty four gallons of water. This means that only about eight percent of the provided water is actually used to humidify the building, with the other ninety-two percent wasted. This waste costs money for the water along with the associated sewer and electrical fees.

Attempts have been made in the prior art to recycle the aqueous condensate resulting from the flue gases generated by the thermal exchanger in the furnace, and for reuse in the furnace humidification system. A first example of this is shown in U.S. Pat. No. 5,570,680, to Payne, and in which such an aqueous condensate is provided as a primary input to the evaporator of the built-in (integrated) furnace humidification system. Payne also teaches utilizing a field installed humidifier external to the furnace which also utilizes the aqueous condensate as the principal aqueous input.

A second example is shown in Dempsey, U.S. Pat. No. 8,794,601, which teaches a humidifier including a membrane permeable to a water component of a condensate supply but impermeable to an acid component. Also disclosed is a housing system for urging an airflow across the membrane to humidify the air with the water component of the condensate supply.

Other references of note include the humidifier system of Charland, U.S. Pat. No. 6,286,501, such including a heat exchange tube adapted to be heated by a furnace as the furnace heats air to be circulated throughout a building (enclosed space). An evaporation tube is in fluid communication with the heat exchange tube and is adapted to being maintained at first level when the furnace is not heating the air. A purge line is in fluid communication with the evaporation tube and is adapted to drain fluid from the humidifier when the furnace is heating air and the fluid is at a second level.

Finally, US 2014/0174423, published to Wang et al., discloses a method and apparatus for humidifying residential and commercial buildings in which a flue gas generated by a residential or commercial furnace is provided to one side of a porous liquid water transport membrane and habitable space air is provided to an opposite side of the porous liquid water transport membrane in an amount sufficient to provide a habitable space air to flue gas volume flow rate ratio of at least 8.3:1. At least a portion of the water vapor in the flue gas is condensed, providing condensed liquid water which is passed through the porous liquid water transport membrane to the habitable space air side of the porous liquid water transport membrane. On the habitable space air side of the membrane, the condensed liquid water is evaporated into the habitable space air, producing humidified habitable space air which is provided to the rooms of the residential and commercial buildings. Beneficially, no supplemental water source is required for the humidification process.

SUMMARY OF THE PRESENT INVENTION

The present invention discloses a retrofit kit and assembly for establishing closed loop humidification utilizing, in one embodiment, high efficiency furnace condensate water as the source of water input into the furnace humidifier, and as opposed to the condensate water typically being dumped into a sump or sewer system, and then pumped to the sewer if into a sump. Components of the kit and assembly include a collection container adapted to being mounted to an exterior location of the furnace house, typically a vertical distance underneath the humidification unit as well as in gravity fed communication with a furnace condensate outlet.

Other components include each of a water pump, float valve, overflow drain line, condensate inlet and humidifier drain inlet line which are combined to provide a closed loop pump system. As previously described, the main water supply is the high efficiency furnace condensate output. Supplemental water is provided, if and as needed, by a city water line connected into the collection container by a float valve. The invention dramatically reduces water and sewer costs in a useful Green application of the relevant technology, and reduces power requirements for a further cost save.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

As previously described, the present invention provides a retrofit kit and assembly for use with an existing furnace/humidifier installation. In particular, the present invention provides closed loop and recyclable resupply of a volume of water to the furnace mounted humidifier for providing humidification of an internal space.

As will be subsequently described with reference to illustrations, the closed loop system can primarily (typically exclusively) operate using the aqueous condensate outlet generated by the normal operation of a high efficiently furnace (this generally represented by three dimensional housing 2 connected to a heated air exhaust 4 via an electrostatic cleaner assembly 6). Also depicted at 8 is a humidifier assembly mounted to an exterior location of the furnace housing and for providing a humidified airflow into the furnace housing 2 for combination with the furnace airflow.

Figure 1:
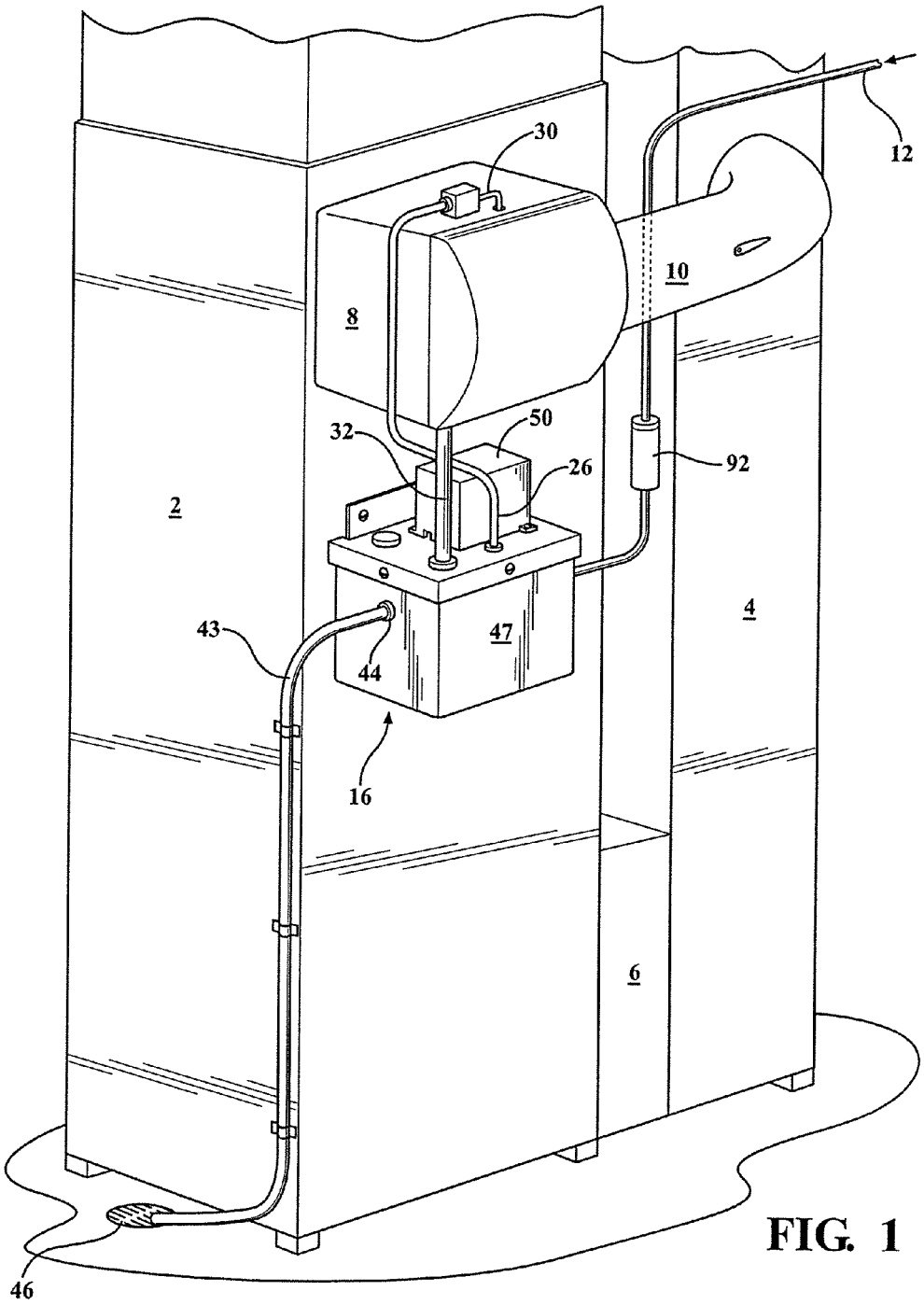
FIG. 1 is an environmental perspective of the closed loop humidification kit and assembly according to a first non-limiting embodiment and which utilizes an external (city) water supply inlet in iterative float actuated communication with the fluid reservoir housing mounted to the furnace exterior underneath the humidifier, the externally mounted housing and humidifier establishing a closed loop for continuous and recyclable use of the water in the interior humidification process.
Figure 4:
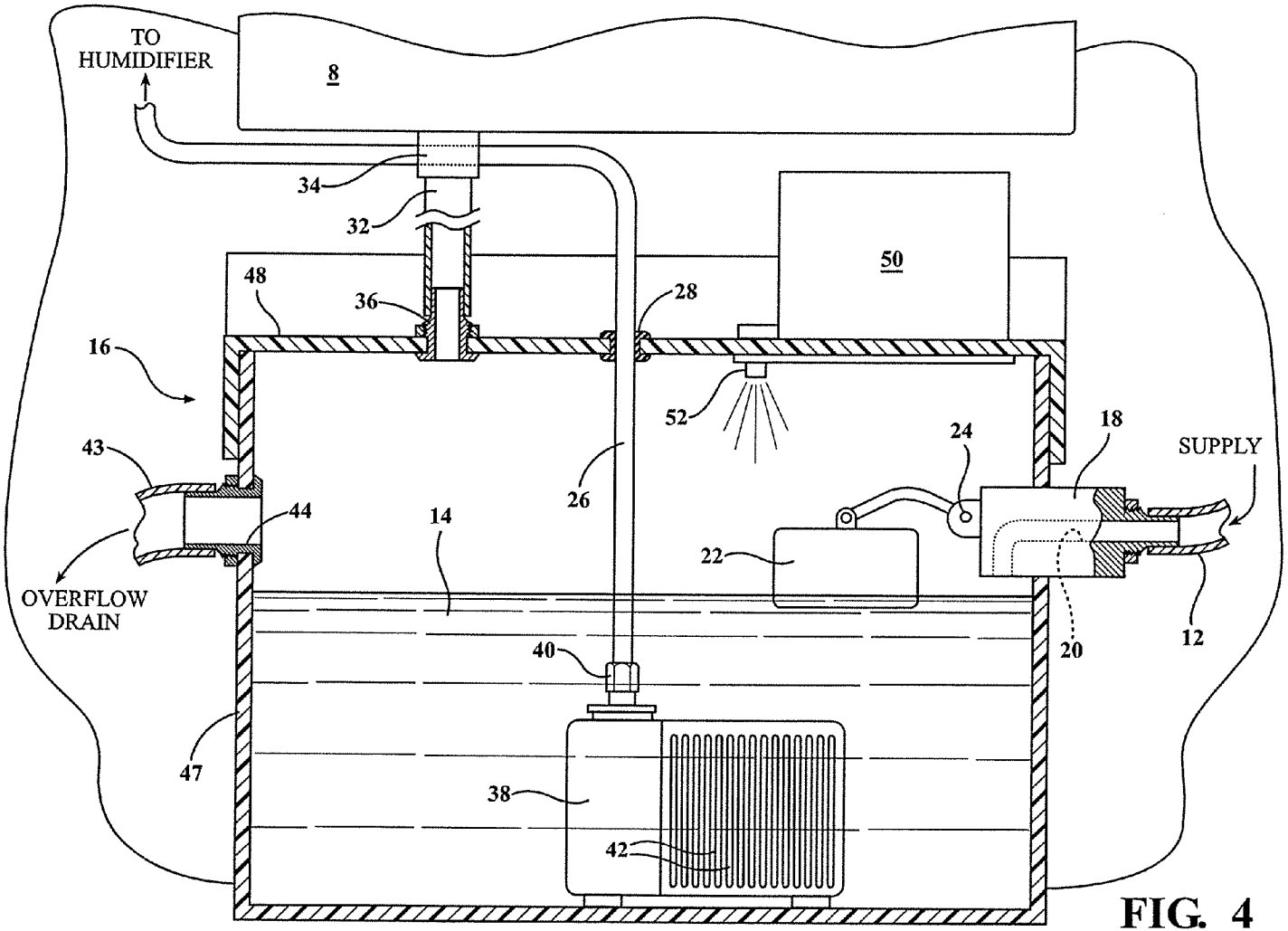
FIG. 4 is a sectional cutaway of the fluid holding reservoir housing depicted in the embodiment of FIG. 1.

Viewing FIGS. 1 and 4 in combination, a first variant of the closed loop humidification kit and assembly utilizes an external (city) water supply inlet, depicted by fluid supply line 12, in iterative float actuated communication with the fluid reservoir, see inner fluid level 14 shown in FIG. 4. The supply line connects to the reservoir housing, generally depicted at 16, at a first location 18 further designated by a fluid sealing through fitting which communicates the inlet supply fluid flow through the supply line 12.

The fitting 18 further exhibits an interior passageway (see at 20) communicating to the interior fluid level 14 for the reservoir. A float 22 (defined as a buoyant component of any suitable construction) is supported upon the fluid surface (level 14) and is connected to a switch (not shown) integrated within the fitting 18 via a hinged connection 24 which, upon the float 22 descending a distance correlating to a loss of fluid below a minimum desired threshold, will result in the switch activing to admit a replacement volume of fluid through the supply inlet line 12 and into the reservoir.

A fluid outlet line 26 extends from a second location 28 (further defined in FIG. 4 cutaway as a fluid sealing grommet incorporated into a lid of the reservoir) of the reservoir defining housing to the humidifier 8 (see inlet location 30 in FIG. 1) for communicating the fluid supply to an evaporator pad (not shown) associated with the humidifier. As is also generally known, the humidifier 8 incorporates a collection of fan, solenoid valve assembly, motor and other known components for admitting the fluid (water) in descending fashion across the humidifier pad, with an intercepting airstream being humidified with the water prior to being communicated through the humidifier outlet 10 and recombined with the heated exhaust 4 for distribution within the enclosed space.

As is also known, a majority component of the fluid passed through the humidifier is not incorporated into the humidified airstream outlet and, as opposed to being dumped directly into a floor sink, is collected at a bottom interior of the humidifier 8 for communication through a fluid return line 32 extending from a bottom fitting 39 of the humidifier 8 to a third location 36 of the housing for returning the remaining unused portion of the fluid supply to the reservoir interior.

Maintaining of the closed loop fluid flow is assisted by a pump 38 incorporated into a submerged interior of the housing 16 and which communicates, at fitting location 40, with an integrated end of the fluid outlet line 26. The pump 38 is activated by a switch separate from that associated with the fluid admittance valve integrated into the supply fitting 18 and, by drawing in fluid from the reservoir through admittance slots or apertures 42 (again FIG. 4) maintains the closed loop fluid network.

Figure 2:
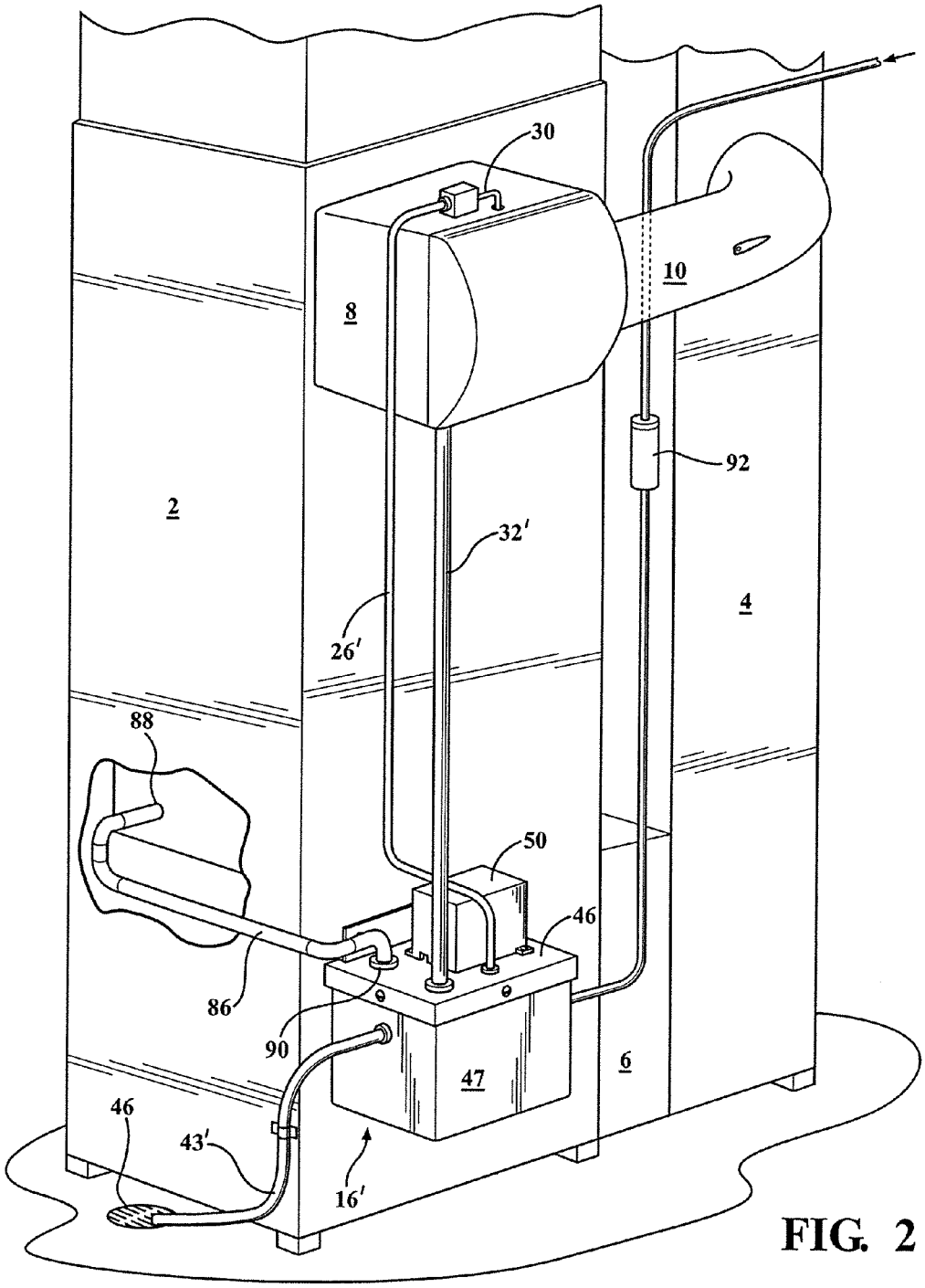
FIG. 2 is a similar environmental perspective of the kit and assembly according to a further non-limiting embodiment and in which the external reservoir housing is mounted at a further lowered exterior location in order to communicate by gravity fed fashion with a condensate outlet line extending from the furnace along with also having an external (city) water supply inlet similar to as shown in FIG. 1.
Figure 6:
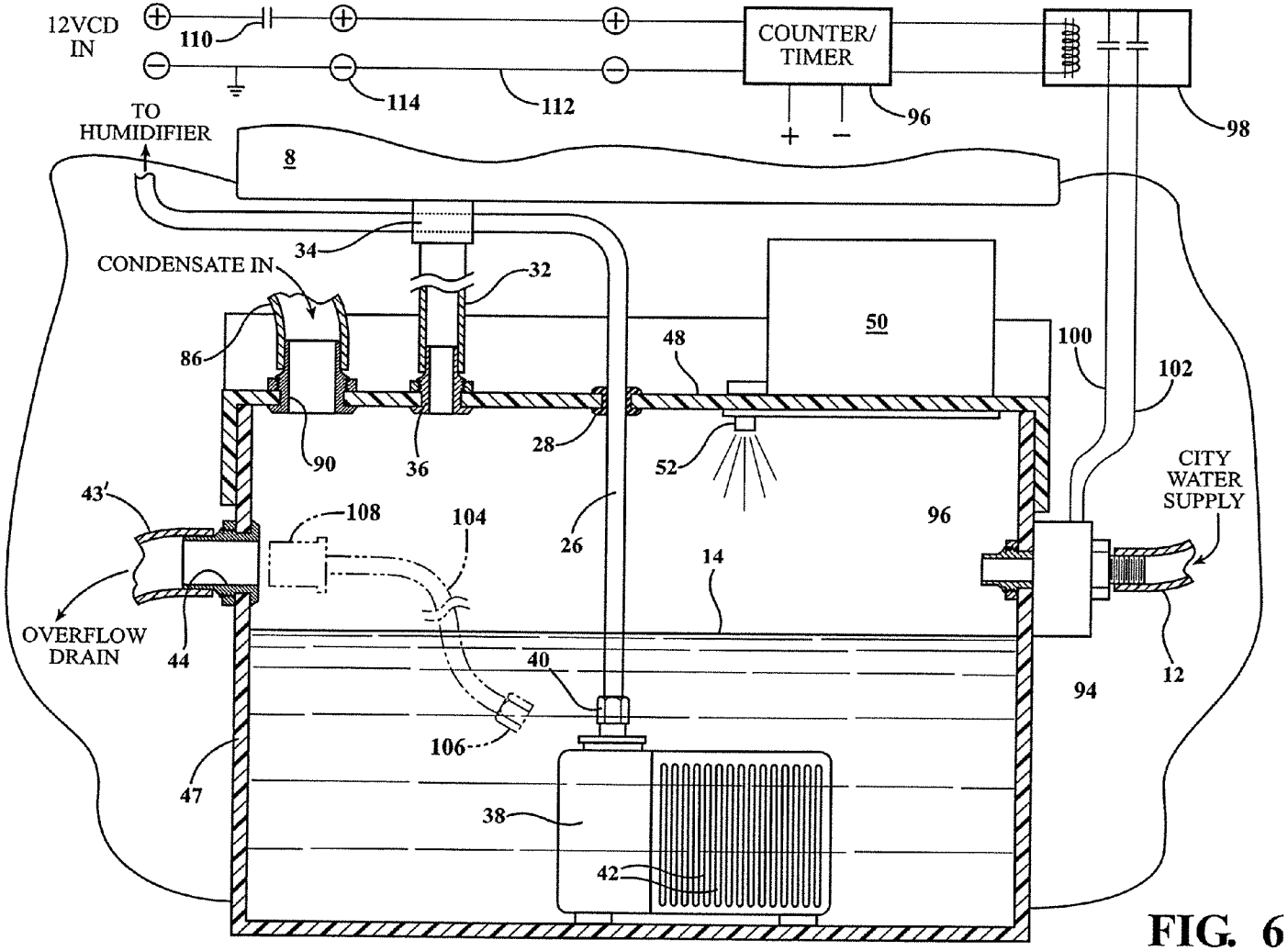
FIG. 6 is a similar illustration to FIG. 5 and further illustrating a purge feature for iteratively replacing a volume of furnace condensate water which may contain an undesirably high acidity level and in order to avoid rusting of any metal components associated with the closed loop assembly.

Also depicted at 43 is an overflow line which extends from a fitting, illustrated in FIG. 4 as a fluid sealing grommet 44 or the like integrated into a fourth side wall location of the reservoir 16 at an interior elevated location above the fluid level 14. The overflow line 43 operates to sink any excess volume of fluid from the reservoir to a floor drain 46 located in proximity to the assembly (typically aside the base of the furnace and associated ductwork). A similar overflow line 43' is illustrated in the variants of FIGS. 2 and 6 and which correspond to a shorter running length (owing to the lowering of the housing 47) as opposed to that shown at 43 in FIG. 1.

Figure 3:
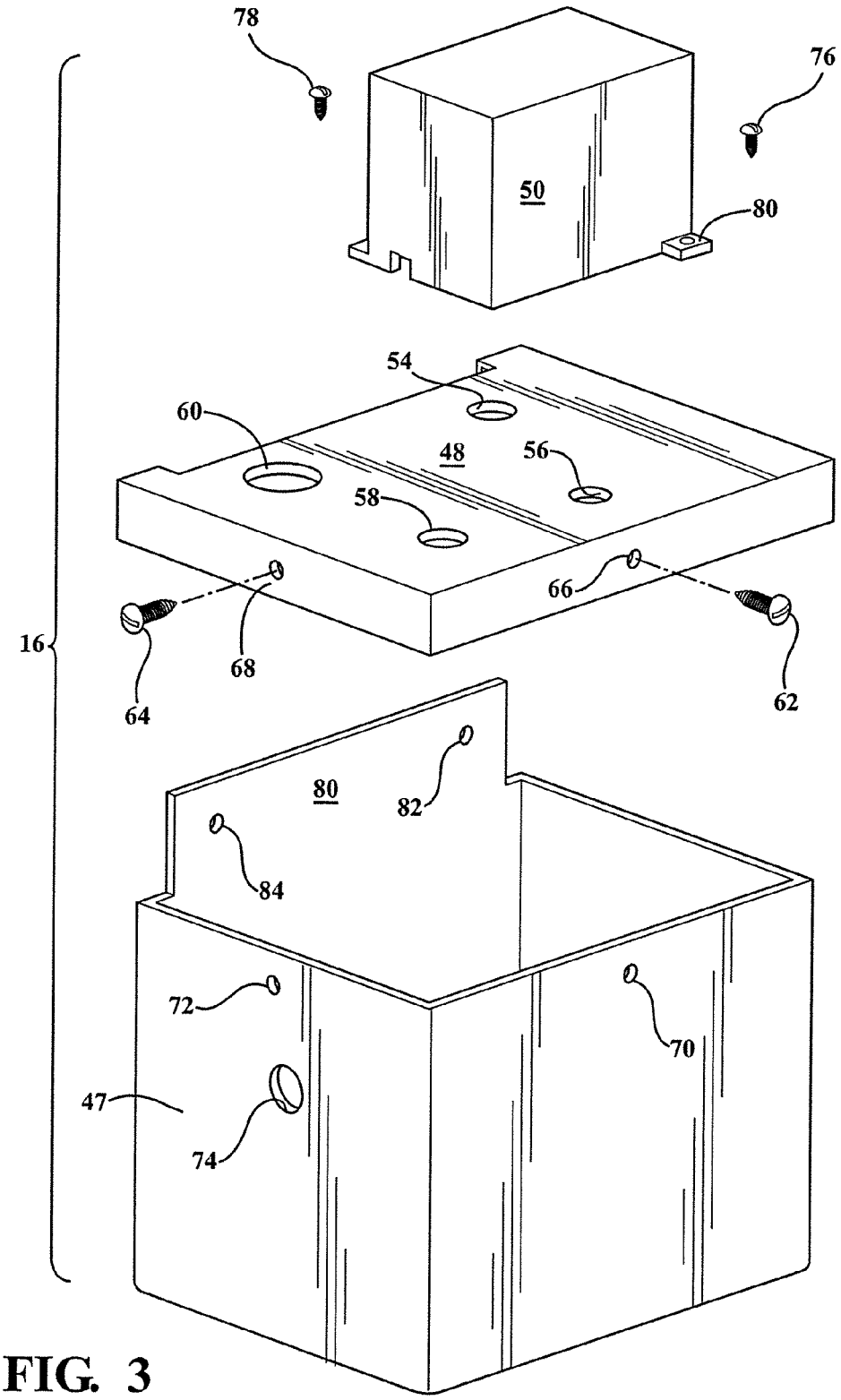
FIG. 3 is an exploded view of the fluid reservoir housing according to one non-limiting embodiment and which illustrates a base (without float switch and pump), a lid and an upper attached UV module for removing biological impurities from the water.

As further shown in FIG. 3, one non-limiting example of the three dimensional shaped housing 16 includes a multi-sided rectangular base 47 with an open top. A lid 48 attaches over the open perimeter of the base 47, the lid in turn integrating a UV (ultra-violet) component 50, such being secured to an exterior surface of the lid and so that a lamp portion 52 of the UV component extends through an aperture (see inner perimeter defining wall 54 in FIG. 3) defined in the lid 48 in overhead fashion relative to the inner reservoir fluid 14, this in order to remove biological contaminants from the reservoir prior to being withdrawn through the fluid outlet 26 and send to the humidifier 8.

Without limitation, the lamp 52 shown in FIG. 4 can be suspended or otherwise affixed to the interior of the lid 48 in any manner desired, such not necessarily requiring an aperture cutout as shown at 54. As also shown in FIG. 3, additional aperture defining perimeter walls 56, 58 and 60 can be configured into the lid 48, these corresponding to each of the fluid outlet 26, fluid return 32 and condensate outlet (FIGS. 2 and 5) lines.

Also depicted are a collection of fasteners (typically screws) 62 & 64 inserting through apertures defined in each of angled side walls of the lid 48 (at 66 & 68) which, upon installing the lid upon the base, are in alignment with additional aperture 70 & 72 proximate upper edge locations of the base 46. A further aperture 74 is shown and corresponds to the placement of the grommet fitting 44 in FIG. 4 for securing the overflow drain line 42.

Additional smaller fasteners (again such as screws) 76 & 78 insert through tabbed or flanged locations along the base of the UV module 50 in order to secure the same to the lid 48 (it again being understood that the lid and UV component can be provided as a single piece or the UV component and lamp be provided as any other optional installation in use with the reservoir and assembly). Finally, an upper extending flange portion 80 of the base 46 further depicts additional apertures (see at 82 & 84) which receive additional screw fasteners or the like (not shown) in order to secure the assembled housing 16 to a selected exterior location of the furnace, such as shown at FIG. 1, and typically beneath and in proximity to the humidifier 8.

Referring now to FIG. 2, a similar environmental perspective of the kit and assembly is depicted according to a further non-limiting embodiment and in which the external reservoir housing, now shown at 16', is mounted at a further lowered exterior location relative to the furnace and humidifier. The location of the housing 16' is in order to communicate, by gravity fed fashion, with a condensate outlet line, see at 86, extending from the furnace to the reservoir, this via a further grommet style fitting 90 secured about the aperture 60 (FIG. 3) in the lid 48.

The operation of the furnace in order to produce an aqueous condensate is known according to the previous description, such that a repeat description is not necessary. As also previously described, the volume of condensate produced in many colder weather climates is sufficient for continued closed loop operation of the system however, and that said, the embodiment of FIGS. 2 and 5 contemplate the furnace condensate supply being provided in combination with the external (city) water supply inlet similar to as shown in FIG. 1.

Figure 5:
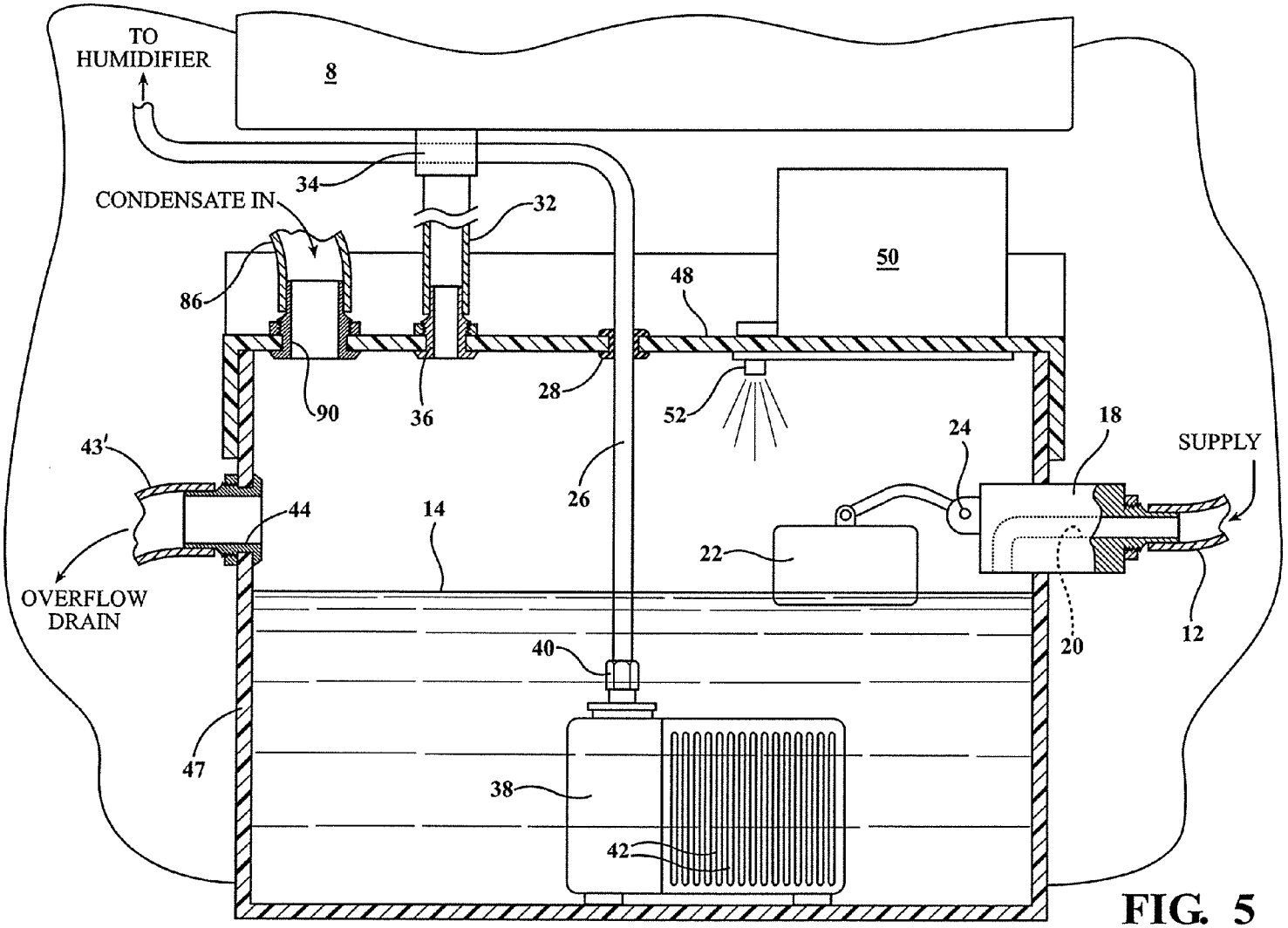
FIG. 5 is a similar cutaway of the fluid holding reservoir in FIG. 2 and further illustrating the gravity feed condensate outlet extending from the furnace (and which is typically fed by a pair of collection lines extending from each of the outlet of the secondary heat exchanger and the base of the exhaust vent past the induced draft fan)

FIG. 5 is a similar cutaway of the fluid holding reservoir in FIG. 2 and further illustrating the gravity feed condensate outlet 86 extending from the furnace (and which is typically fed by a pair of collection lines extending from each of the outlet of the secondary heat exchanger and the base of the exhaust vent past the induced draft fan). Otherwise, similar features from the embodiment of FIGS. 1 and 4 are repeated without duplicate explanation, it further being noted that the fluid outlet and return lines extending between the reservoir and the humidifier are lengthened in FIG. 2 as shown at 26' and 32' respectively from that depicted in FIG. 1 and in order to accommodate the lowered engaged location of the housing 16' to accommodate the gravity draining of the furnace condensate through line 86 (it also being envisioned that the housing can also be repositioned and a separate pump utilized as needed to communicate the condensate outflow into the reservoir interior).

Consistent with the above description, one non limiting protocol for the operation for an active humidifier with condensate recovery is described as follows:

1. The building thermostat calls for the high efficiency furnace to supply heat to the building.
2. The high efficiency furnace turns on and starts its normal warm up cycle.
3. If the cold air return mounted humidistat calls for humidity, the humidifier will turn on.
4. When the furnace is at operating temperature, the internal fan will turn on, and provide 110 VAC to the collection container mounted submersible water pump.
5. The submersible pump output water is routed to the top of the humidifier evaporator pad.
6. The excess water that is not used in the humidification process drains out the bottom of the humidifier.
7. The humidifier excess water is routed into the collection container where it adds to the already available water supply.
8. At the same time the furnace starts, it begins to generate condensate water.
9. The condensate water drains down into the collection container, where it also adds to the already available water supply.
10. If the condensate water added by the furnace is less than that required to humidify the building, the city water float valve will open and add the required water to fill the collection container.
11. If the condensate water added by the furnace is more than that required to humidify the building, the excess will drain off thru the overflow line.
12. The overflow line is routed into the sump or city sewer line.
13. This operation will continue until the furnace shuts off.
14. The power will be dropped from the collection container mounted submersible pump.
15. The condensate water will stop.
16. The humidifier excess water will stop.
17. The city water float valve will function to keep the water level at the required height if necessary.

The Pump:

The pump is a submersible style, with water lift distance of at least 7 feet. The pump will pull water from the collection container, and discharge it through a ¼" flexible line run to the inlet of the humidifier. The pump is operated from 110 VAC, and will turn on and off with the humidifier. The flow rate at the humidifier inlet should be about eight ounces per minute. An aquarium style pump with the necessary specs would be typical.

Float Valve:

The float valve has a hollow plastic or metal float attached to a cantilever arm. The arm presses on a rubber stopper that is in series with the water inlet. As the water level goes up, more pressure is exerted on the rubber stopper, thus shutting off the water coming in from the city water connection. The inlet to the float is connected to the city water system. The float is mechanically connected to the side of the collection container, through a hole drilled in the container. The hole is sealed to prevent water from leaking out the hole drilled in the container.

Collection Container:

The collection container is made of a water proof material. It could be plastic, metal, or any UV insensitive material that will contain water, not leak, and be rigid enough to support fittings and the float valve. A lid is also required made out of a material that will allow it to be drilled and allow fittings to be inserted. The fittings are for the excess water discharge from the humidifier, and the condensate in from the furnace. The container must be internally large enough to hold the pump and float valve, along with enough water to keep the pump completely submerged. The float valve is mounted above the top of the pump, ensuring that the condensate output from the furnace is less than the humidifier usage, the float valve will open, keeping the water level above the top of the pump, and not subject to deterioration by UV light.

Overflow:

Another fitting is drilled through the side of the container, to which the overflow drain line is installed. This line is installed just above the shut off level of the float valve. If the furnace condensate water output is higher than the humidifier usage rate, the water level will rise, and drain out through the drain hole into the sump or city sewer.

Power:

Power to operate the submersible pump is supplied by tapping off of the motor wires in the active humidifier, or by adding a 24 VAC relay, and switching 110 VAC from a wall plug when the passive humidifier runs.

Detailed Operation:

Humidifiers are used in both residential and commercial buildings. Added humidity is necessary in the winter to improve the comfort level in the building. With improved humidity, lower fuel costs can be achieved because it feels warmer at a lower room temperature. With the advent of high efficiency furnaces, condensate water is now available. Typically, the condensate water is discharged as waste. This invention requires a high efficiency furnace along with a humidifier system. The invention was developed and prototyped on a high efficiency furnace along with a typical evaporator drip pad humidifier. There are two types of evaporator drip pad humidifiers: 1. Passive, 2. Active—Meaning a fan in the humidifier blows air thru the evaporator pad into the furnace hot air stream. Basic baseline operation of the system is:

1. City water is supplied to the humidifier. An electrically operated solenoid would turn on the water supply to start the process once the cold air return mounted humidistat calls for humidity.
2. The humidifier will turn on when the furnace fan starts.
3. With the furnace fan running, the passive system starts the city water dripping down the evaporator pad. The active system works the same way except the humidifier fan will turn on the force more water thru the pad.
4. The unused water (The water that did not make it into the furnace hot air stream) drips out the bottom of the humidifier.
5. A hose runs from the bottom of the humidifier over to either a sump or directly into the sewer line.
6. If into a sump, when the sump reaches its upper fill limit, the pump will turn on, and pump the water out, and into the city sewer system.

The invention modifies this process by adding a collection container, city water float valve, and electrically powered pump. The electric solenoid is no longer needed in the humidifier. The collection container contains a pump, fittings, drain line, and float valve. The hose from the bottom of the humidifier is taken from the sump/sewer and fed into the top of the collection container. The city water line going into the humidifier is plumbed into the inlet of the collection container mounted float valve. An optional in-line water filter 92 (FIG. 1) may be placed in this line to improve the city water quality going into the collection container. A submersible pump, again at 38, is located in the bottom of the collection container, and its output is fed to the inlet of the humidifier. Power to the submersible pump is provided by the 110 VAC of the humidifier fan on the active system, or by a 110 VAC line plugged into a wall socket and switched by an added 24 VAC relay, which is turned on by the passive humidifier. The condensate outlet 86 from the furnace is fed into the top of the collection container (again through fitting 90), just like the humidifier discharge line. An overflow line is run from just above the full collection container full water level. This overflow line will drain into the sump or the city sewer line.

A related process is also described as follows (Active Humidifier):

1. The furnace turns on.
2. If the cold air return mounted humidistat calls for humidity, the humidifier will turn on.
3. 110 VAC is supplied to the submersible water pump in the collection container.
4. Because the container is full of water filled with water by previous runs from the furnace condensate drip or city water inlet, water is pumped up to the humidifier inlet.
5. The excess water drips out the bottom of the humidifier and into the collection container.
6. At the same time, the furnace is now discharging condensate which is also going into the collection container.
7. If the condensate drip is not enough to keep the collection container full, the city water float valve will open and let in city water to reach the full level then shut off.
8. If the condensate drip is supplying more water than is being used by the humidifier, the excess will drain off through the overflow line into the sump or sewer line.
9. This process will continue until the furnace shuts off
10. The furnace shuts off, and the pump power is stopped since the humidifier powered fan stops.
11. The water pump will stop, the furnace condensate will stop, the humidifier drip will stop, and the city water float valve will monitor the collection container water level and allow in water if needed.
12. The collection container is full of water and waiting for the next run cycle.

A further related process is as follows (Passive Humidifier):

1. The furnace turns on.
2. If the cold air return mounted humidistat calls for humidity, the humidifier will turn on.
3. A 24 VAC relay powered by the humidifier, supplies 110 VAC from a wall plug to the submersible pump.
4. Because the container is full of water filled with water by previous runs from the furnace condensate drip or city water inlet, water is pumped up to the humidifier inlet.
5. The excess water drips out the bottom of the humidifier and into the collection container.
6. At the same time, the furnace is now discharging condensate which is also going into the collection container.
7. If the condensate drip is not enough to keep the collection container full, the city water float valve will open and let in city water to reach the full level then shut off.
8. If the condensate drip is supplying more water than is being used by the humidifier, the excess will drain off through the overflow line into the sump or sewer line.
9. This process will continue until the furnace shuts off.
10. The furnace shuts off, and the pump power is stopped since the humidifier powered 24 VAC stops.
11. The water pump will stop, the furnace condensate will stop, the humidifier drip will stop, and the city water float valve will monitor the collection container water level and allow in water if needed.
12. The collection container is full of water and waiting for the next run cycle.

Consistent with the above descriptions, the present invention provides a simple, environmentally friendly, and cost effective approach to home humidification. The invention uses the condensate water output from today's high efficiency furnaces instead of city water to supply water to a typical furnace mounted humidifier. In many cold weather climates, enough condensate water is extracted by a high efficiency furnace from the outside air, to supply the humidification needs of the building. If required, supplemental water is supplied from a city water float valve. The use of the invention reduces the cost for water, sewerage, and electricity, along with reduced humidifier maintenance costs due to removing city water impurities from the humidifier water supply.

Additional features can include the provision of a suitable filter associated with the city inlet 12 (as shown at 92 in FIGS. 1-2) for filtering the water admitted into the housing 16/16'. Although not shown, a suitable filter may also be utilized in the furnace condensate outlet 86 fluid lines for supplying the reservoir housing 16/16' in closed loop fashion.

In the further instance of the furnace condensate line 86, it has been determined that the acidity level of the aqueous condensate may cause rusting of the steel components of the housing 16 or humidifier 8 over time. To counter this, and referring finally to FIG. 6, a purge feature is illustrated for iteratively replacing a volume of furnace condensate water which may contain an undesirably high acidity level and in order to avoid rusting of any metal components associated with the closed loop assembly.

The diagram of FIG. 6 is similar in respects to that previously described in FIG. 5 and illustrates in cutaway a yet further variant 16" of the housing assembly and in which the inlet water fitting 18 of FIG. 5 is substituted by a solenoid 94 which is secured to a side location of the main reservoir body 46 at an approximate height equal to the fitting 18. As with the city water inlet variants of FIGS. 1-2, the inlet fluid line 12 is engaged to an inlet end of the solenoid 94 which also includes an outlet fitting 96 engaged to an aperture associated with the side of the housing for providing intake of fluid.

Associated circuitry includes a counter/timer 96 which is communicated to the solenoid 94 via a relay 98 with wires 100 & 102, these extending from the solenoid (24 VAC or 110 VAC) to the relay (again 24 VAC or 110 VAC input with 12 VDC output). A conduit 104, see as shown in phantom with first 106 and second 108 opposite end fittings is optionally provided according to one subset operation and which, when it is desired to purge the interior contents of the housing, may be attached to each of the outlet 40 of the pump 38 (via first end 106) as well as the overflow drain fitting 44 (via second end 108) following disconnection of the regular pump outlet fluid line 26 from the pump outlet 40), and further such that the conduit 104 can be disconnected from the overflow fitting 44 and pump 38 when not in use so that the conduit 26 can be reattached to the pump 38 for resumed closed circuit flow, and the overflow drain can separately operate as previously described.

As further shown in FIG. 6, the associated circuitry further includes a pump relay 110 in communication with the counter/timer 96, an input 112. The counter/timer 96 is configured to monitor a discrete number of run cycles associated with the pump 38, this determined to constitute an allowable duration of recycling or reuse of the furnace condensate fluid, and prior to the fluid achieving an undesirable level of acidity requiring replacement before it begins to rust or otherwise adversely affect the metal construction of the various components within the assembly.

According to one non-limiting protocol not requiring disengagement of the fluid outflow line 26 and attachment of the substitute conduit 104 between the pump 38 and the overflow drain fitting 44, the pump relay 110 sends a 12 VDC signal to the counter 96, which is preset to a number of run cycles which, when reached, will begin to purge the collection chamber. Upon the desired number of cycles accruing, the city water solenoid valve 94 is opened so that city water will begin refill the container.

As the container is refilled, the water level will exceed the height of the overflow opening (as defined by through fitting 44), the added water mixed with the acidic laden condensate water will flow out the overflow into the floor sump. The city water is continuously run for a predetermined length of time (using a timer) to ensure that the acidic water has been fully purged. At this point, the solenoid valve 94 is closed, the counter/timer 96 reset to zero and standard closed loop operation of the system begins anew.

According to a further non-limited operational protocol, and upon achieving a specified number of run cycles of the pump 38 during normal closed loop operation, the outlet fluid line 26 is disconnected and the purging conduit line 104 attached in extending fashion between the pump fitting 40 and overflow fitting 44. At this point, the relay 110 closes and a pump run signal 114 is issued in order to activate the pump 38 to discharge the contents of the reservoir through the overflow line 43' and out the drain. Following emptying of the internal reservoir 14, the fluid line 26 is reattached for normal operation and the solenoid 94 activated to refill the reservoir with city inlet water through line 12.

Aside from the variant disclosed, and which provides only one example of a purge line, any other non-limiting construction can be provided for integrating any type of purge or backwash feature and can include providing the necessary conduits along with a solenoid and level switch (and as opposed to utilizing a float valve). This can further include the construction of the purge line being permanently integrated into the assembly so that both purge and overflow draining can be provided without the requirement of attaching or replacing existing fluid lines, such as provided in the first afore-described operational protocol for purging the acidic water concurrent with admitting the fresh city inlet water.

Having described my invention, additional preferred embodiments will become apparent to those skilled in the art to which it pertains, and without deviating from the scope of the appended claims.

I claim:

1. A retrofit assembly for establishing closed loop water supply to a humidifier associated with a furnace, comprising:

a reservoir defining housing adapted to being mounted to a location of the furnace;

a fluid supply communicated to said housing;

said fluid supply further including a condensate outlet extending from the furnace;

a fluid outlet line extending from a location of said housing to the humidifier for communicating the fluid supply to an evaporator pad associated with the humidifier; and a fluid return line extending from the humidifier to a further location of said housing for returning a remaining unused portion of the fluid supply.

2. The assembly as described in claim 1, said fluid supply further comprising a city water inlet line.

3. The assembly as described in claim 1, further comprising an ultraviolet lamp mounted above an interior of said reservoir.

4. The assembly as described in claim 2, further comprising a float switch at an interior location of said reservoir communicating with said fluid supply.

5. The assembly as described in claim 1, further comprising an overflow line extending from said reservoir in communication with a floor drain.

6. The assembly as described in claim 1, further comprising a fluid pump mounted at a submerged interior location of said reservoir, said pump communicating with said fluid outlet line.

7. The assembly as described in claim 3, said reservoir further comprising a three dimensional base, a lid secured atop said base, a module containing said ultraviolet lamp secured upon said lid and so that said lamp extends through an aperture defined in said lid.

8. The assembly as described in claim 7, further comprising a mounting flange incorporated into a rear wall of said base, at least one aperture defined in said flange for receiving a mounting fastener there through in order to secure said reservoir to the furnace.

9. A retrofit kit for installation to an existing furnace and humidifier assembly, a heated air exhaust extending from an outlet of the furnace, an outlet extending from the humidifier and combining with the heated exhaust, said kit comprising:

a reservoir defining housing adapted to being mounted to a location of the furnace;

a fluid supply line communicated to said housing;

said fluid supply further including a condensate outlet extending from the furnace;

a fluid outlet line extending from a location of said housing to the humidifier for communicating the fluid supply to an evaporator pad associated with the humidifier;

a fluid pump mounted at a submerged interior location of said reservoir, said pump communicating with said fluid outlet line; and a fluid return line extending from the humidifier to a further location of said housing for returning a remaining unused portion of the fluid supply.

10. The kit as described in claim 9, said fluid supply further comprising a city water inlet line.

11. The kit as described in claim 9, further comprising an ultraviolet lamp mounted above an interior of said reservoir.

12. The kit as described in claim 10, further comprising a float switch at an interior location of said reservoir communicating with said fluid supply.

13. The kit as described in claim 9, further comprising an overflow line extending from said reservoir in communication with a floor drain.

14. The kit as described in claim 11, said reservoir further comprising a three dimensional base, a lid secured atop said base, a module containing said ultraviolet lamp secured upon said lid and so that said lamp extends through an aperture defined in said lid.

15. The kit as described in claim 14, further comprising a mounting flange incorporated into a rear wall of said base, at least one aperture defined in said flange for receiving a mounting fastener there through in order to secure said reservoir to the furnace.

16. A kit for providing closed loop humidification to a humidifier associated with a furnace, comprising:

a reservoir defining housing adapted to being mounted to a location of the furnace;

a city inlet fluid supply line communicated to a location of said housing;

a furnace condensate fluid inlet supply line communicated to a further location of said housing;

a fluid outlet line extending from a pump supported within said reservoir, through said housing, and to the humidifier for communicating the fluid supply to an evaporator pad associated with the humidifier;

a fluid return line extending from the humidifier to an interior of said housing for returning a remaining unused portion of the fluid supply in a first closed loop operation;

an overflow line extending from a fourth location of said reservoir in communication with a floor drain;

a purge line attachable to said pump and extending to a fitting associated with said overflow line; and a switch for activating said purge line to empty the reservoir through said overflow line in a second operation.

17. The kit as described in claim 16, further comprising a solenoid communicating said city inlet fluid supply line with said reservoir housing, a switch activating said solenoid to refill said reservoir following purging.

18. The kit as described in claim 17, further comprising a counter communicated with said pump and indicating an iterative number of cycles requiring purging.

* * * * *